US006637525B2

(12) United States Patent
Watanabe et al.

(10) Patent No.: US 6,637,525 B2
(45) Date of Patent: Oct. 28, 2003

(54) GROUND DRILLING MACHINE AND ROD EXCHANGER UTILIZED THEREFOR

(75) Inventors: Kentaro Watanabe, Kawasaki (JP); Toyohiko Youan, Kawasaki (JP); Kazuyuki Yamazaki, Kawasaki (JP); Tooru Hishiyama, Kawasaki (JP)

(73) Assignee: Komatsu Ltd. (JP)

( * ) Notice: Subject to any disclaimer, the term of this patent is extended or adjusted under 35 U.S.C. 154(b) by 59 days.

(21) Appl. No.: 09/988,410

(22) Filed: Nov. 19, 2001

(65) Prior Publication Data

US 2002/0062994 A1 May 30, 2002

(30) Foreign Application Priority Data

Nov. 29, 2000 (JP) ..... P2000-363543

(51) Int. Cl.[7] ..... E21B 19/14; E21B 15/00
(52) U.S. Cl. ..... 175/52; 175/220; 173/164
(58) Field of Search ..... 173/164; 175/52, 175/82, 220

(56) References Cited

U.S. PATENT DOCUMENTS 3,985,189 A * 10/1976 Jahnke et al. ..... 175/52
4,049,065 A * 9/1977 Walter ..... 175/52
4,258,796 A * 3/1981 Horning et al. ..... 175/52
4,897,009 A * 1/1990 Powell ..... 175/52
5,575,344 A * 11/1996 Wireman ..... 175/85

FOREIGN PATENT DOCUMENTS

JP 58-189493 11/1983
JP 04108992 A * 4/1992 ..... E21B/19/20
JP 04269295 A * 9/1992 ..... E21B/19/20

* cited by examiner

*Primary Examiner*—David Bagnell
*Assistant Examiner*—Brian Halford
(74) *Attorney, Agent, or Firm*—Rader Fishman & Grauer PLLC

(57) ABSTRACT

A ground drilling machine includes a machine body a rod propelling device, a rod exchanging device and a support unit provided for the machine body for supporting the rod exchanging device. The rod propelling device has a frame movably mounted to the machine body. The frame is slidable on a support portion provided for the machine body. The rod exchanging device is attached to the frame of the rod propelling device via a transverse mounting member. The rod exchanging device is also supported on the support unit so as to be slidable on the support unit along with the movement of the rod propelling device without changing of its relative position to the rod propelling device. The rod exchanging device can be made light and compact because the rod exchanging device is supported by the support unit which is provided for the machine body and accordingly a large bending load is not applied to the main body portion of the rod exchanging device.

4 Claims, 21 Drawing Sheets

GROUND DRILLING MACHINE AND ROD EXCHANGER UTILIZED THEREFOR

BACKGROUND OF THE INVENTION

1. Field of the Invention

The present invention relates to a ground drilling machine such as earth drilling (boring) machine for drilling a bore in earth for embedding, without open-cut operation to the earth, gas pipe, electric cable, signal cable sheath tube, fiber cable, water-supply pipe, sewer (sewage) pipe and the like, and a crawler drill for boring an earth to insert an explosive for blasting use, and also relates to a rod exchanger utilized for such ground drilling machine.

2. Prior Art

Prior art provides a crawler drill such as disclosed in Japanese Patent Laid-open Publication No. SHO 58-189493.

The crawler drill disclosed in this publication is equipped with a freely travelling vehicle body, a frame structure mounted to the vehicle body, a drilling unit movable along the frame structure, a rod having, at its front end, a drill bit and rotated and propelled by this drilling unit and a rod exchanger mounted to the frame structure. The rods are incorporated in the rod exchanger so that the rods are accommodated in turns to the drilling unit to sequentially drill the earth (ground).

This rod exchanger is provided with a main body into which a plurality of rods are accommodated and a rod exchanging unit or section mounted to the main body so as to carry the rods between the main body and the frame structure. The main body of the rod exchanger is mounted to the side surface of the frame structure.

Accordingly, in such crawler drill of the prior art, since the rod exchanger is cantilevered by the frame structure, a large load is applied to the frame structure, so that it is obliged to make the frame structure large and heavy.

Furthermore, in such crawler drill, a large bending load will be applied to the machine body of the rod exchanger, and particularly, a large load will be applied to a portion of the machine body which is mounted to the frame structure. Therefore, it becomes necessary to make the strength of that portion large so as to allow an entire weight of the rod exchanger to be supported, thus making the size and weight of the rod exchanger large and heavy, being disadvantageous.

As mentioned above, large size and heavy weight of the frame structure and the rod exchanger result in large load acting on the vehicle body of the crawler drill, and hence, the vehicle body itself is made large and heavy.

Such defects bring the entire structure of the crawler drill having a large size and heavy weight, and hence, it is difficult to carry out the drilling working by the crawler drill set at a narrow site or portion. The entire height (from the ground surface) of the crawler drill is high, preventing worker's visibility, and moreover, it is difficult for the worker to exchange the rods and carry out the rod propelling operation and, moreover, any safe operation cannot be expected because of high position of the gravity center of the crawler drill.

The body of the rod exchanger is formed with a plurality of rod accommodation (receiving) recesses arranged along a circular locus thereof. The rod exchanging unit is composed of a swingable arm and a pair of claws provided, to be opened or closed, at the front end portion of the arm. A rod accommodated in the recess formed to the rod exchanger body is grasped by the paired claws, and the arm is swung and carried to the frame. When reached to the frame, the rod is released from the claws and the rod is then connected to the drilling unit. According to the manner reverse to that mentioned above, the rod is accommodated in the recess of the rod exchanger body.

In order to carry out the aforementioned operation, it is necessary to secure a large space for the swing motion of the claws in opposite sides of the rod diametral direction at the time when the rod received in the rod accommodation recess is grasped. Therefore, the fact that the large space is required leads to a defect that it is necessary to increase a distance between adjacent two rods accommodated in the recesses of the rod exchanger body, and hence, the number of the rods to be accommodated is reduced.

SUMMARY OF THE INVENTION

An object of the present invention is to substantially eliminate defects or drawbacks encountered in the prior art mentioned above and to provide a ground drilling machine capable of making a frame structure light and compact and a rod exchanger utilized therefor capable of accommodating a lot of rods without increasing an arrangement or location space.

This and other objects can be achieved according to the present invention by providing a ground drilling machine comprising:

- a machine body;
- a rod propelling device having a frame structure mounted to the machine body;
- a rod exchanging device mounted to the frame structure of the rod propelling device; and
- a support unit provided for the machine body for supporting the rod exchanging device.

According to this structure, since the rod exchanging device is supported by the machine body, a load to be applied to the frame structure of the rod propelling device can be reduced, so that the frame structure can be made light and compact.

Furthermore, since a large bending load is not applied to the main body portion of the rod exchanging device, the rod exchanging device itself can be made light and compact. Particularly, any large load is not applied to the portion through which the rod exchanging device is mounted to the frame structure, so that this portion can be especially made light and compact.

As mentioned above, the frame structure, the rod exchanging device and the portion through which the rod exchanging device is mounted to the frame structure are all made light and compact, so that the load to be applied to the machine body can be reduced, thus making the machine body compact and light, resulting in the realization of the light and compact entire structure of the ground drilling machine.

Accordingly, the ground drilling machine having a large working capacity can be installed in a narrow working site such as on a sidewalk or a narrow path, thus improving a working efficiency.

Moreover, since the total height of the ground drilling machine can be made low, the visibility of an operator can be improved and the rod exchanging working and rod propelling working can be performed smoothly. Also, the ground drilling machine can have a low center of gravity to be stable.

In a preferred embodiment of the above aspect, the frame structure is movably mounted to the machine body and also the rod exchanging device is movably supported by the support unit also.

According to this structure, the rod exchanging device is moved together with the frame structure, so that the rod propelling device can be easily set to an aimed ground position. Moreover, since the positional relationship between the frame structure and the rod exchanging device is always constant, the rod exchanging working can be done regardless of the position of the frame structure.

Furthermore, the frame structure and the rod exchanging device can be simultaneously moved with respect to the machine body and the support portion of the machine body, respectively, the width of the moving contact portions thereof can be made large, so that the movement thereof can be stably performed and the machine body can be easily and accurately set to the aimed position with less swing motion thereof.

Furthermore, according to the present invention, there is also provided a rod exchanging device, particularly for the ground drilling machine of the aspect mentioned above, comprising:

a main body portion;

a rod accommodation portion mounted to the main body portion for accommodating a plurality of rods with a space from each other; and a rod exchanging unit provided with a rod grasping device having a grasping portion which is movable between a position inside the main body portion and a position outside the main body portion, the grasping portion being formed with a fixed portion and a movable portion.

According to this structure, the rod can be grasped by both the fixed portion and the movable portion even in a presence of a small space capable of one movable portion being moved near the rod accommodated in the rod accommodation portion, and therefore, the space between the adjacent rods accommodated in the rod accommodation portion can be made small and, hence, a lot of rods can be accommodated.

The rod accommodation portion may provide a disc shaped structure adapted to accommodate a plurality of rods along the circular locus thereof with a space from each other and to be rotatable.

According to this structure, rod accommodation portion can be made rotatable which requires less space for accommodation, thus providing a light and compact rod exchanging device.

The nature and further characteristic features of the present invention will be made more clear from the following descriptions made with reference to the accompanying drawings.

DESCRIPTION OF THE PREFERRED EMBODIMENT

One preferred embodiment of the present invention will be described hereunder with reference to the accompanying drawings.

Figure 1:
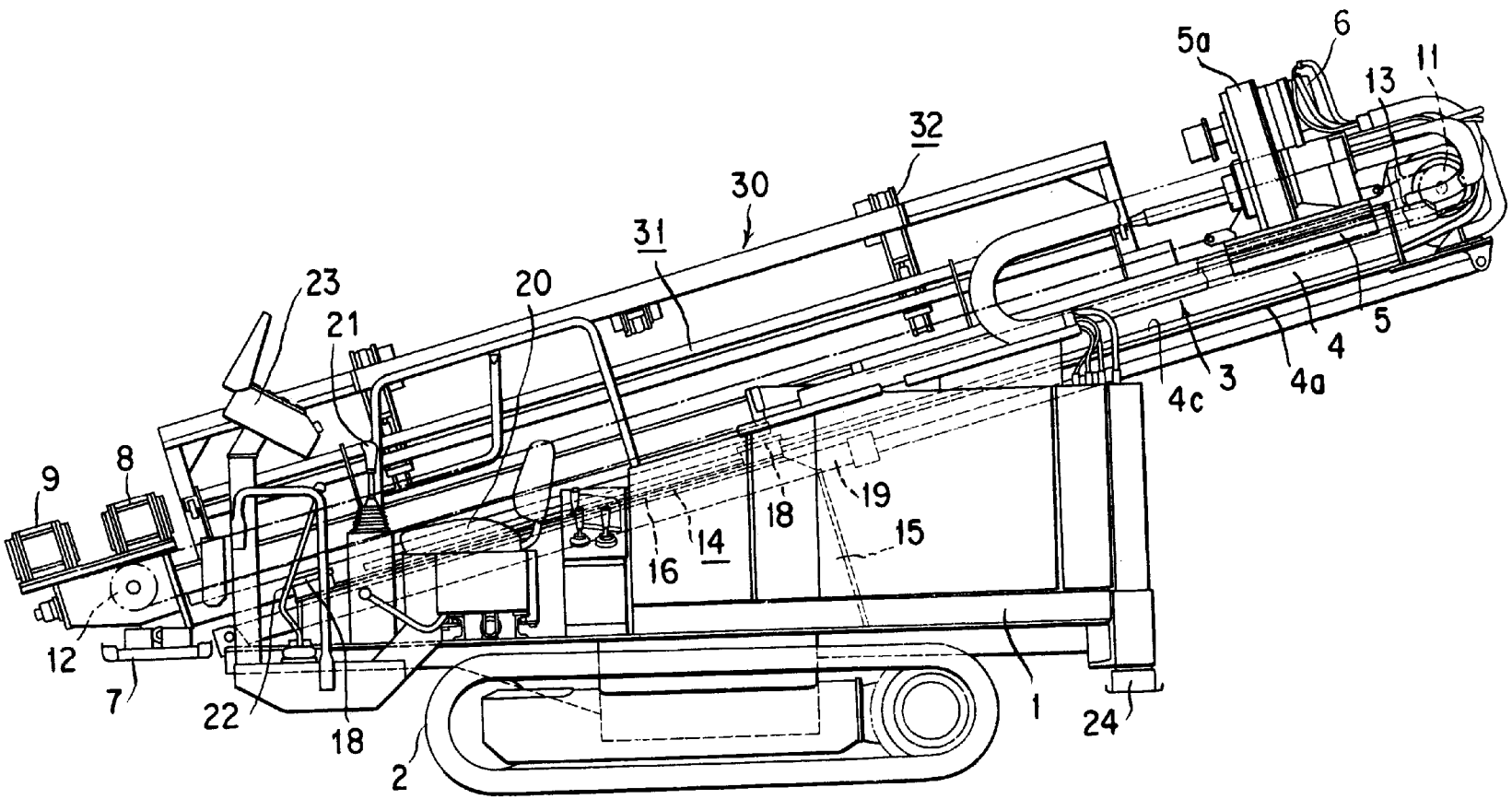
FIG. 1 is a right side view showing one embodiment of a ground drilling machine according to the present invention.
Figure 2:
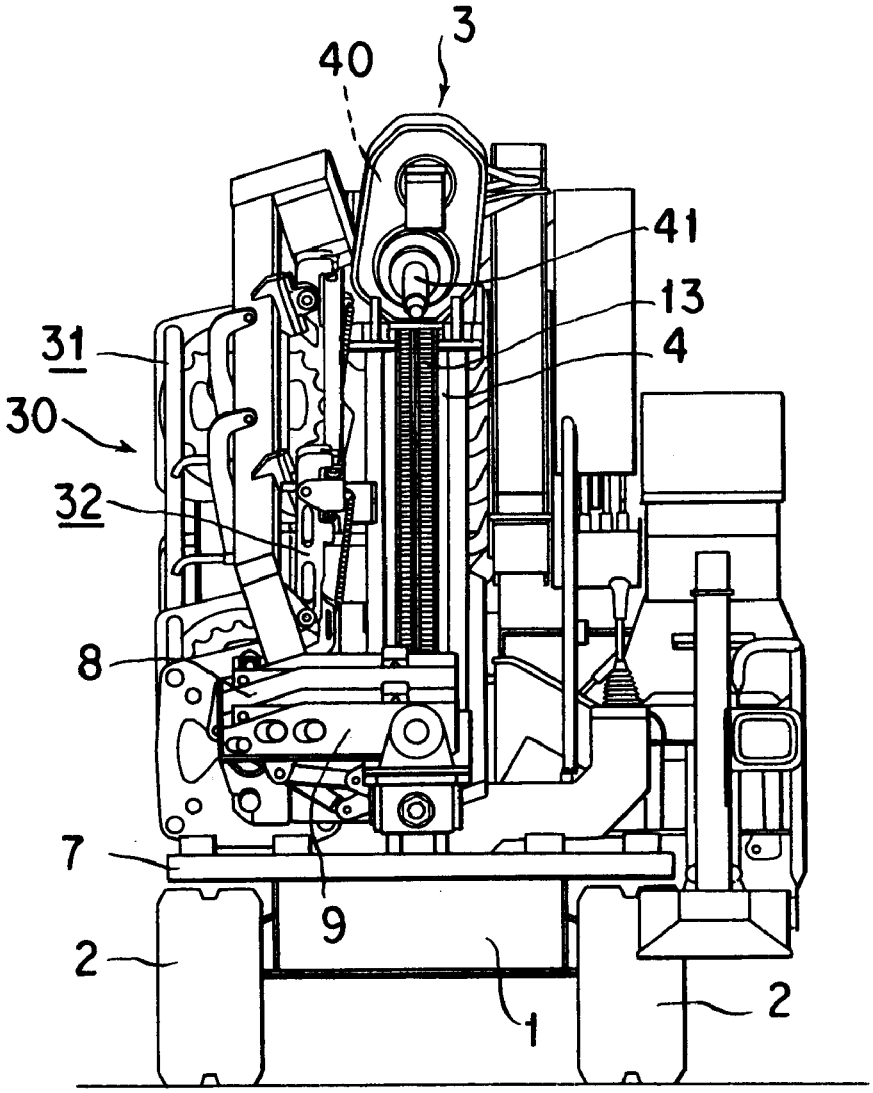
FIG. 2 is a front view of the ground drilling machine of FIG. 1.
Figure 3:
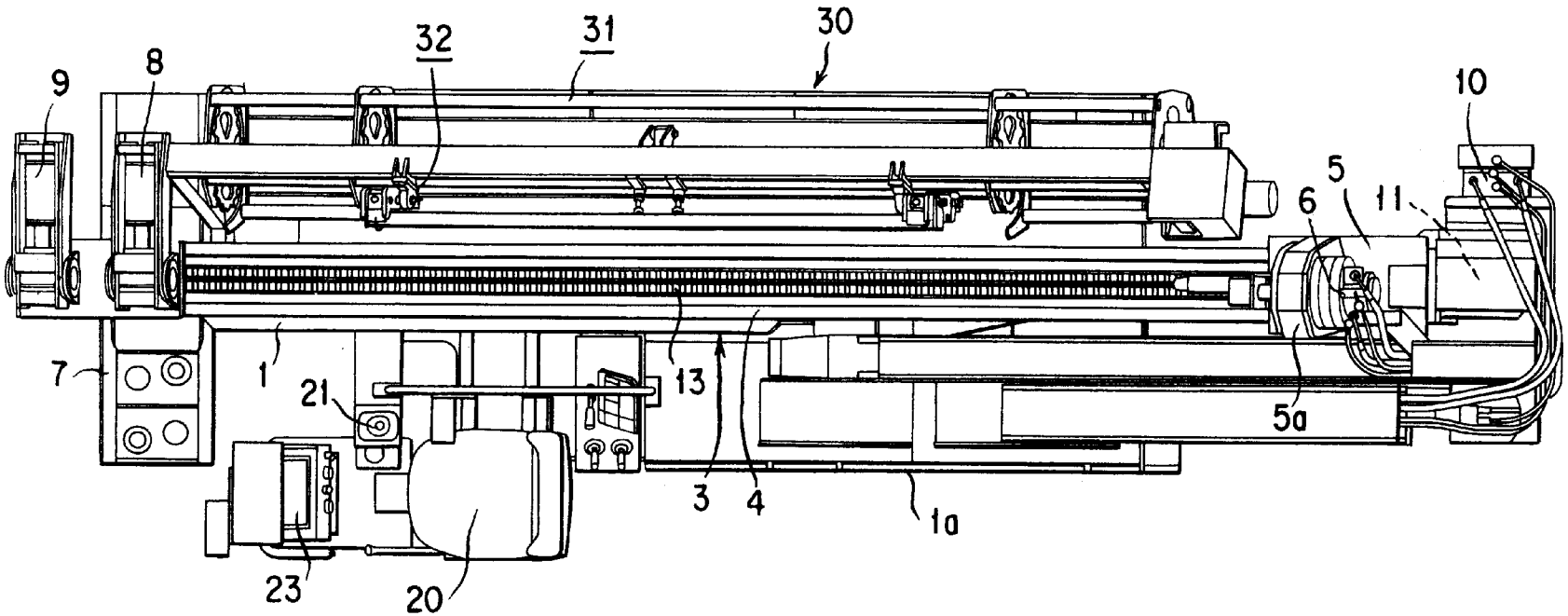
FIG. 3 is a plan view of the ground drilling machine of FIG. 1.

First, with reference to FIGS. 1 to 3, a ground drilling machine of the present invention has a machine body 1 to which a pair of travelling bodies 2 are mounted at its both lateral side portions. Each of these travelling bodies 2 are of crawler type structure, but may be composed of wheel type structure. The machine body 1 may be formed as self-propelled type or portable type.

A rod propelling device 3 is mounted to a central position in the width direction of the machine body 1, i.e., central portion between the paired travelling bodies 2, to be movable in forward and rearward (longitudinal) direction in an inclined manner such that the front side portion thereof is positioned to be lower than the rear side portion with respect to a horizontal plane.

The rod propelling device 3 is provided with a frame 4, which may be called hereunder as frame structure 4, a cradle 5 reciprocally movable along the longitudinal direction of the frame 4, a motor 6 for rotating a rod mounted to the cradle 5, an anchor fixing portion 7 mounted to a front lower portion of the frame 4, a rod wrench 8 mounted to a front upper portion of the frame 4, a rod damper 9, and a rod propelling motor 10 disposed to a rear portion of the frame 4. Thus, the rod propelling device 3 is provided with a mechanism for reciprocally moving the cradle 5.

This mechanism for reciprocally moving the cradle 5 is provided with a driving (drive) sprocket 11 mounted to a rear portion of the frame 4, a driven sprocket 12 mounted to a front portion of the frame and a chain stretched around these driving and driven sprockets 11 and 12.

The driving sprocket 11 is rotated in a reversible manner by means of rod propelling motor 10, and the chain 13 is connected to the cradle 5. According to such structure, when the driving sprocket 11 is normally rotated by the rod propelling motor 10, the cradle 5 is moved forward and then when rotated reversibly, the cradle 5 is moved rearward, thus performing the reciprocal motion.

Figure 4:
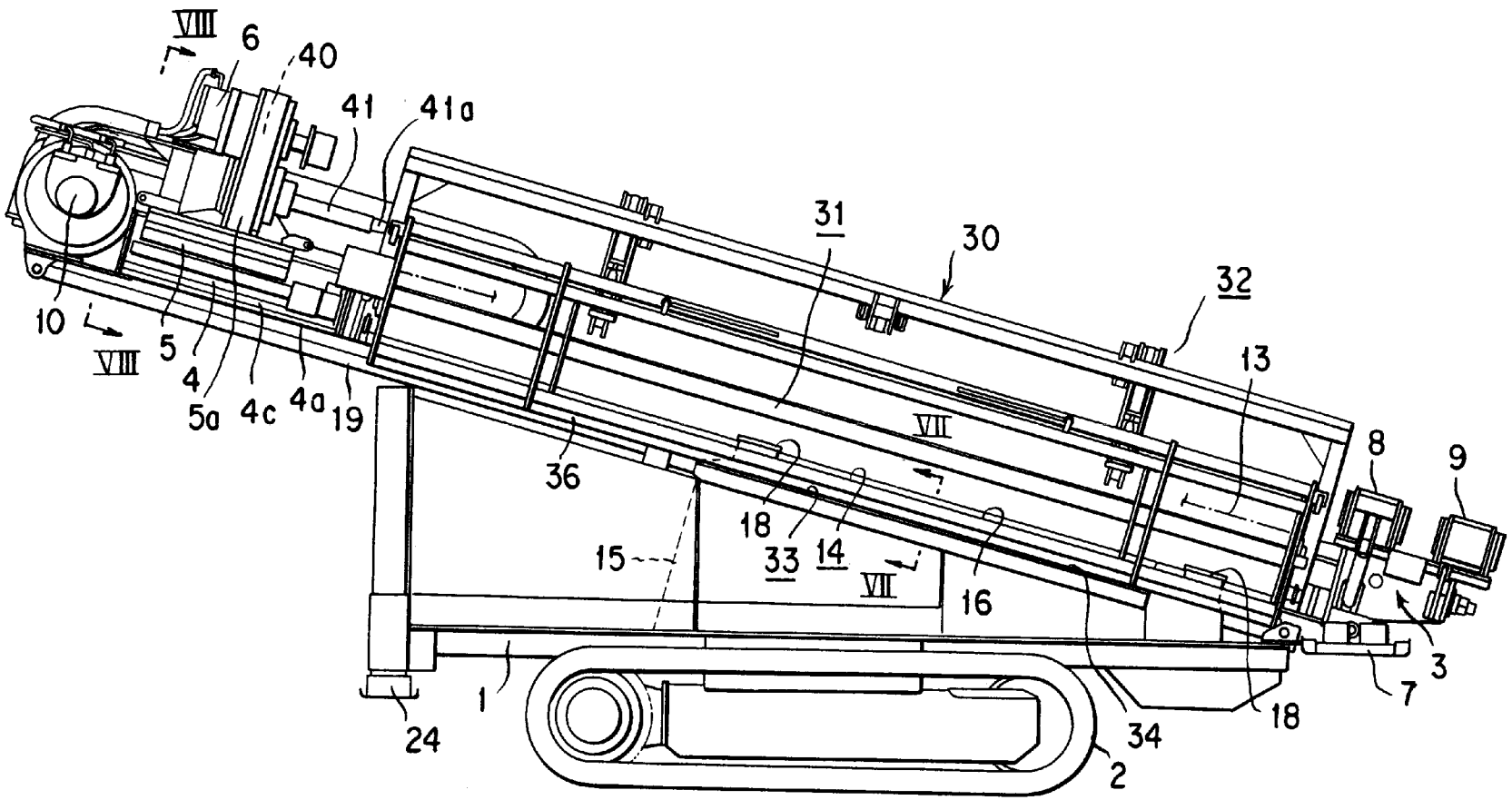
FIG. 4 is a left side view of the ground drilling machine of FIG. 1.
Figure 5:
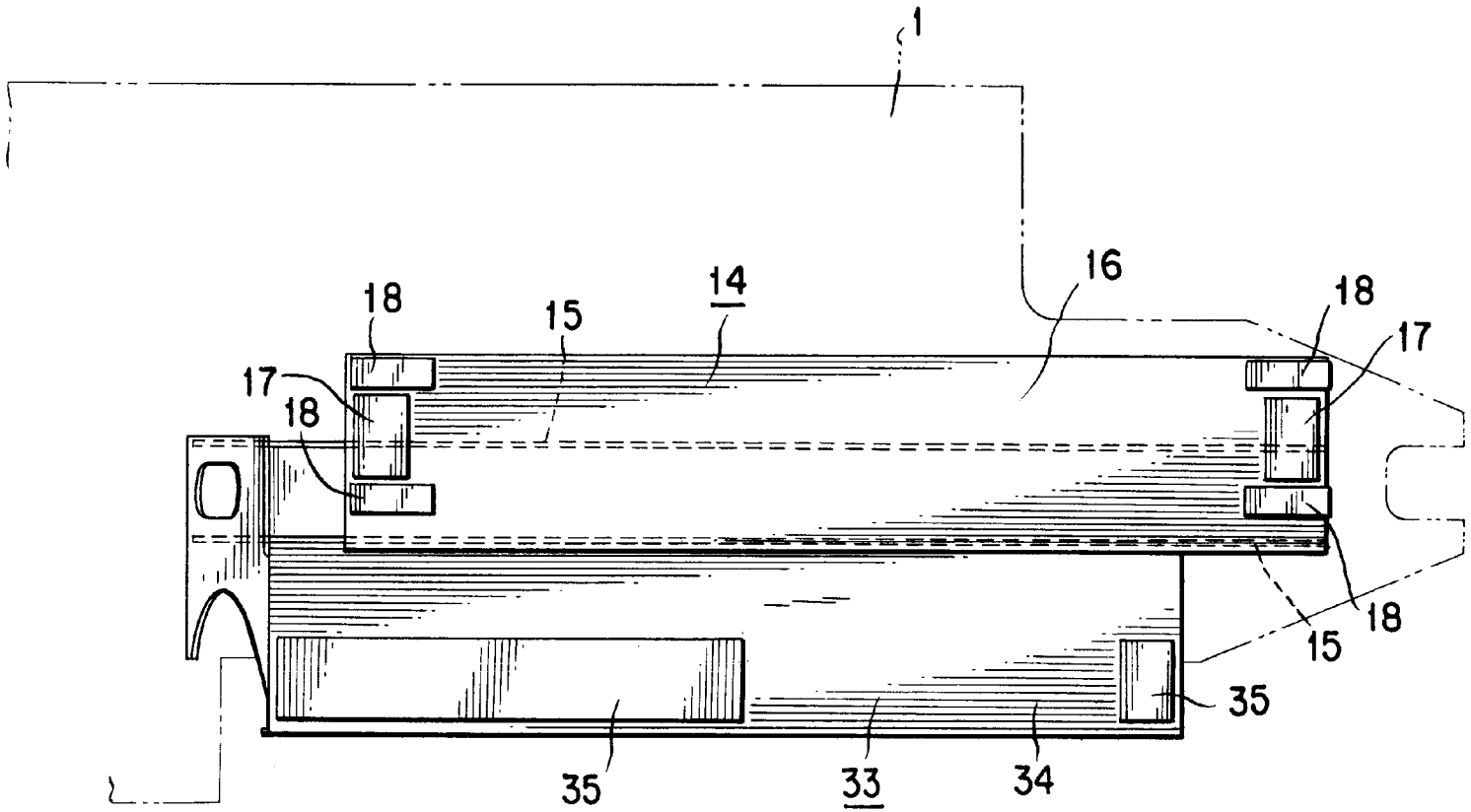
FIG. 5 is a schematic plan view of a support portion (structure) of the ground drilling machine of FIG. 1.
Figure 6:
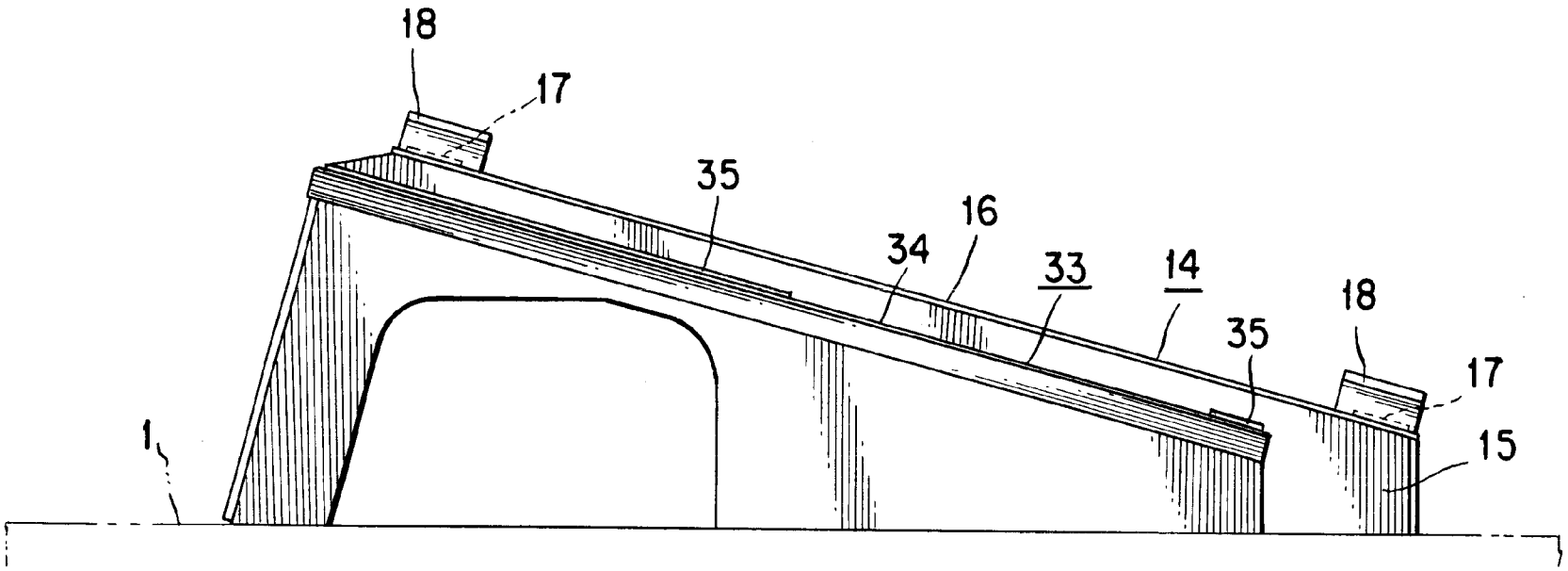
FIG. 6 is a left side view of the support structure of FIG. 5.

As shown in FIGS. 1 and 4, the machine body 1 is provided with a support portion (structure) 14 for supporting the frame structure 4 of the rod propelling device 3 in an inclined attitude. The support structure 14 is provided, as shown in FIGS. 5 and 6, with a plurality of vertical plates 15 and horizontal plates 16, the latter being inclined so that the front side portion thereof is lower than the rear side portion with respect to the horizontal plane.

A slide surface plate 17 and a lateral pair of side surface guide pieces 18 are disposed to each of front and rear end portions of the horizontal plate 16. The slide surface plate 17 is formed of a material having a small friction coefficient.

Figure 7:
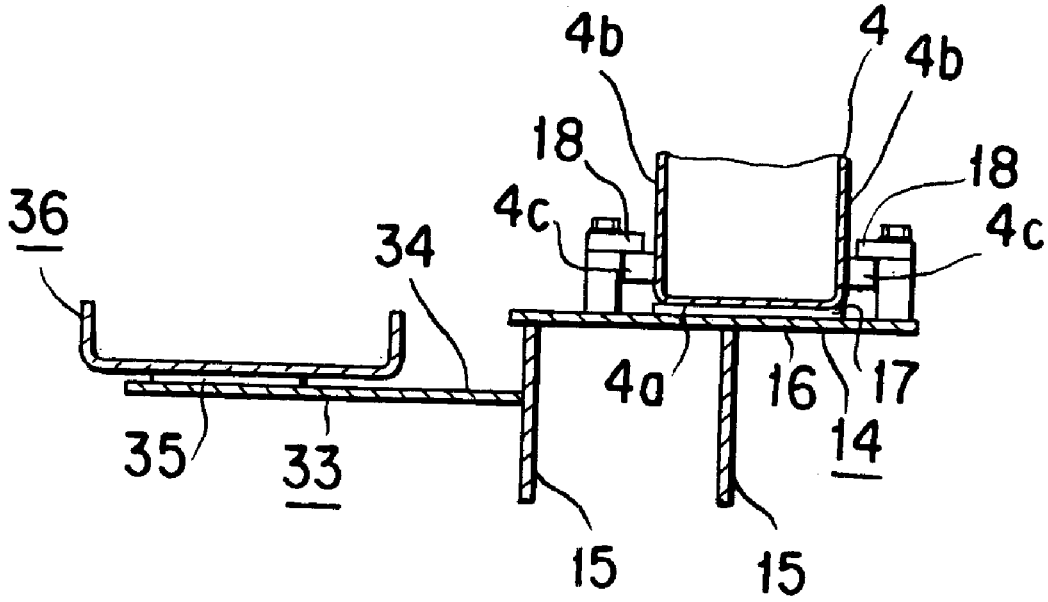
FIG. 7 is an enlarged sectional view taken along the line VII—VII in FIG. 4.

Referring to FIG. 7, the frame 4 has a lower surface 4*a*, as viewed, which is rested on the slide surface plate 17 so that the frame 4 is supported by the support structure 14 to be movable in the longitudinal direction thereof. Protruded members 4*c* are formed on lateral side surfaces of the frame 4 so as to be contacted to lower surfaces of the side surface guide pieces 18 to thereby prevent the frame 4 from raising.

A cylinder (or cylinder assembly) 19 for movement is disposed, for example, as shown in FIG. 1, between the front side portion of the machine body 1 and the rear side portion of the frame 4.

When this cylinder 19 is operated to be expanded, the frame 4 is moved rearward, then, the anchor fixing portion 7 is separated from the ground surface, and the rod propelling device 3 takes its non-working position (machine body travelable position) such as shown in FIG. 1.

On the contrary, when the cylinder 19 is operated to be contracted, the frame is moved forward, then, the anchor fixing portion 7 is contacted to the ground surface, and the rod propelling device 3 takes its working position.

Further, the machine body 1 is provided, at its front one side portion, with an operator's seat 20, a working machine lever 21, a travelling lever 22, a control board 23 and so on as shown in FIG. 1 and FIG. 3.

With reference to FIG. 3, the operator's seat 20, the travelling lever 22 and the control board 23 are disposed to be movable between a projected position projected from a lateral one side surface of the machine body 1 and an accommodation position having the surface position substantially flash with the above-mentioned lateral one side surface of the machine body 1.

A lateral pair of outriggers 24 are mounted to lateral side portions of the rear end portion of the machine body 1.

Further, a rod exchanger (rod exchanging device) 30 is mounted to a portion of the frame 4 opposing to the operator's seat 20.

The rod exchanger 30 is provided with a body portion 31 into which a plurality of rods are detachably accommodated and a rod exchanging portion 32 at which the rod is received from or transported to the frame 4. The body portion 31 is detachably mounted to the side surface of the frame 4.

As shown in FIGS. 4, 5 and 6, a support portion (structure) 33 for supporting the rod exchanger 30 is formed to the vertical plate 15 of the machine body 1. The support structure 33 has an upper surface 34 inclining in the same direction and at substantially the same angle as those for the horizontal plate 16, and slide surface plates 35 are attached to the front and rear end side portions of the upper surface 34 of the support structure 33.

A slide (slidable) frame 36 is mounted to an entire surface of the lower portion of the body portion 31 of the rod exchanger 30, and this slide frame 36 is rested on a slide surface plate 35, as shown in FIG. 7, so that the body portion 31 is supported by the support structure 33 to be movable in the longitudinal (i.e., forward and rearward) direction. One of these support structure 33 and slide frame 36 may be composed of a roller member.

According to the structure mentioned above, the rod exchanger 30 is supported by the support structure 33 of the machine body 1 through the slide frame 36 to be movable in the longitudinal direction along the support structure 33 together with the frame structure 4 of the rod propelling device 3.

The respective members or structures mentioned above will be described hereunder more concretely.

Figure 8:
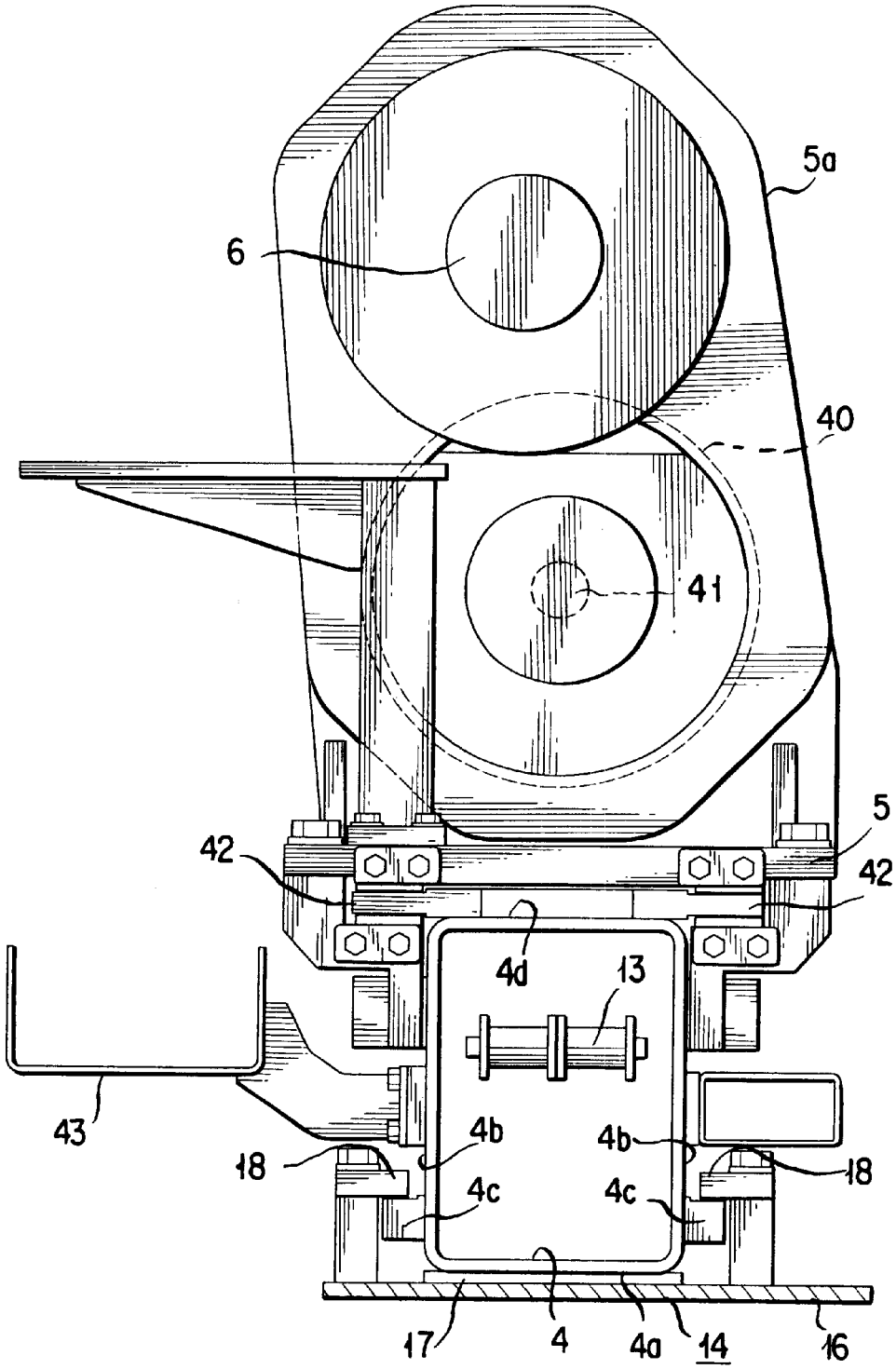
FIG. 8 is an enlarged sectional view taken along the line VIII—VIII in FIG. 4.

With reference to FIGS. 4 and 8, the rod rotating motor 6 and a reduction mechanism 40 are fixed to an upright (standing) portion 5*a* of the cradle 5, and an output side of the rod rotating motor 6 is coupled to a rotation shaft 41 through the reduction mechanism 40, and the front end portion of the rotation shaft 41 is formed as a screw portion 41*a*.

The cradle 5 clamps a lateral pair of guide plates 42 fixed to the upper surface 4*a* of the frame 4 in a slidable manner to be reciprocally movable along the guide plates 42.

A hose receive member 43 is mounted to a side surface 4*b* of frame 4 on the side of the operator's seat 20.

As shown in FIG. 3, the output side of the rod propelling motor 10 is operatively connected to the driving sprocket 11.

Figure 9:
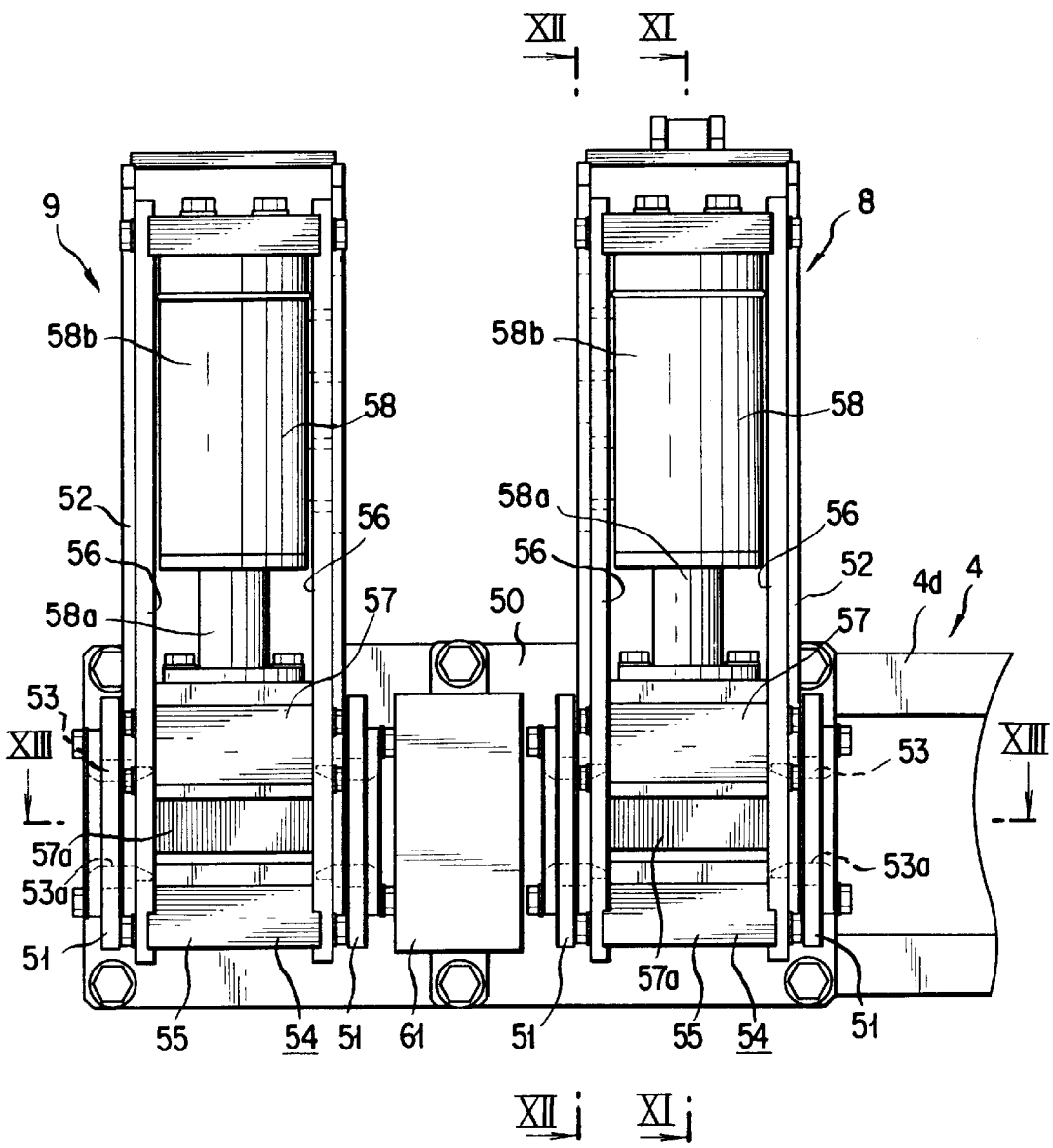
FIG. 9 is a plan view, in an enlarged scale, of a section including a rod wrench and a rod damper of the ground drilling machine of FIG. 1.
Figure 10:
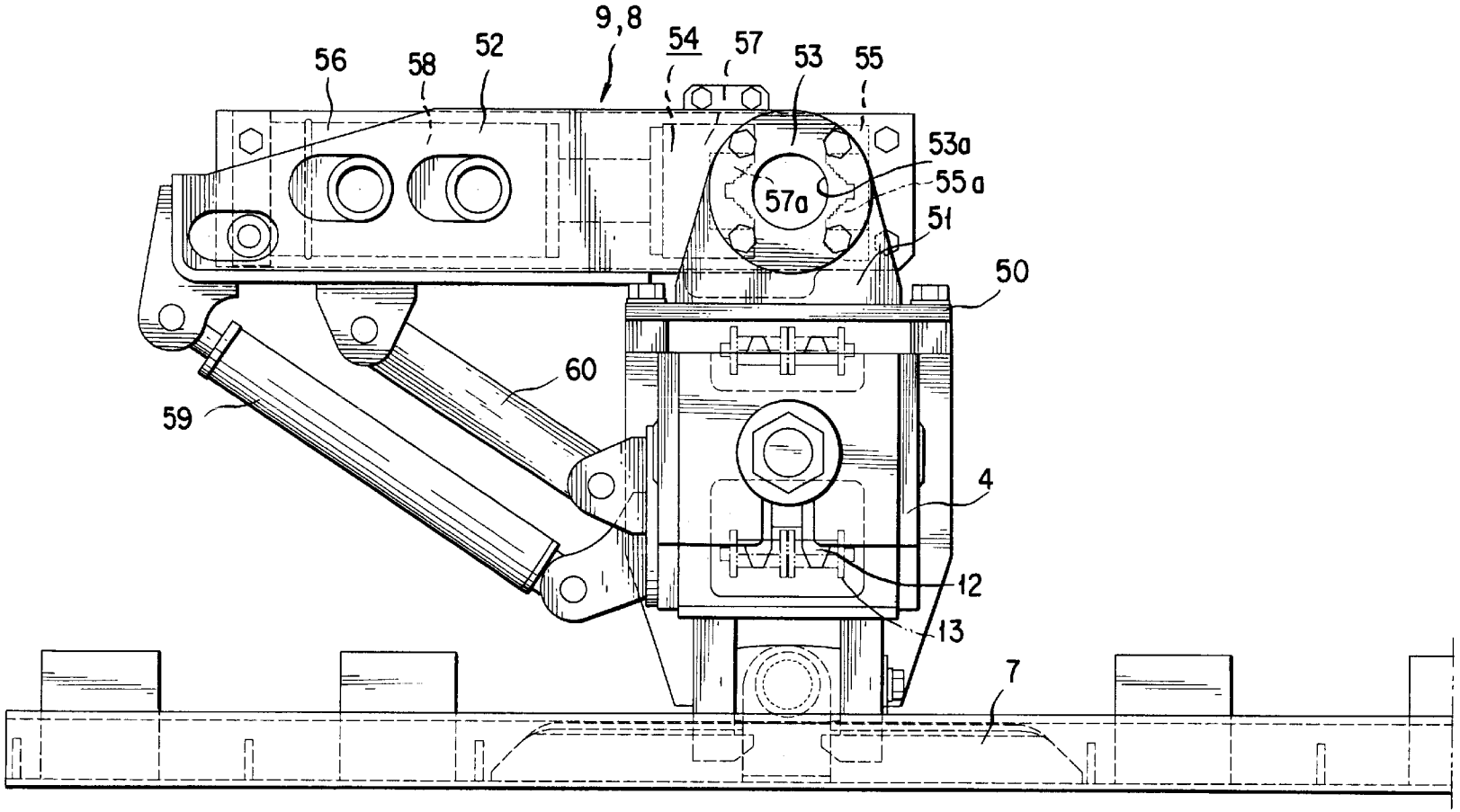
FIG. 10 is a front view, in an enlarged scale, of a section including the rod wrench and the rod clamper of FIG. 9.

Furthermore, the rod wrench 8 and the rod damper 9 have substantially the same structure except that the former has a cylinder 59 and the latter instead has a link 60, the cylinder 59 and the link 60 being mentioned hereunder, and as shown in FIGS. 9 and 10, each of the wrench 8 and rod clamper 9 has a structure that a box-shaped body 52, having an upper opening in cross section, is mounted to be vertically swingable with a pair of hollow pins 53 to a set of brackets 51 of a plate 50 attached to the upper surface 4*d* of the frame 4, and a rod grasping member 54 is mounted to the body portion 52.

The rod grasping member 54 is provided, as shown in FIG. 9, with a pair of side plates 56 attached, through pin-slot connection, to the body portion 52 to be movable by a predetermined stroke, a stationary grasping portion 55 fixed to the side plates 56, a movable grasping portion 57 movable along the paired side plates 56 and a cylinder (cylinder assembly) 58 attached to the side plates 56 so as to move the movable grasping portion 57.

Figure 11:
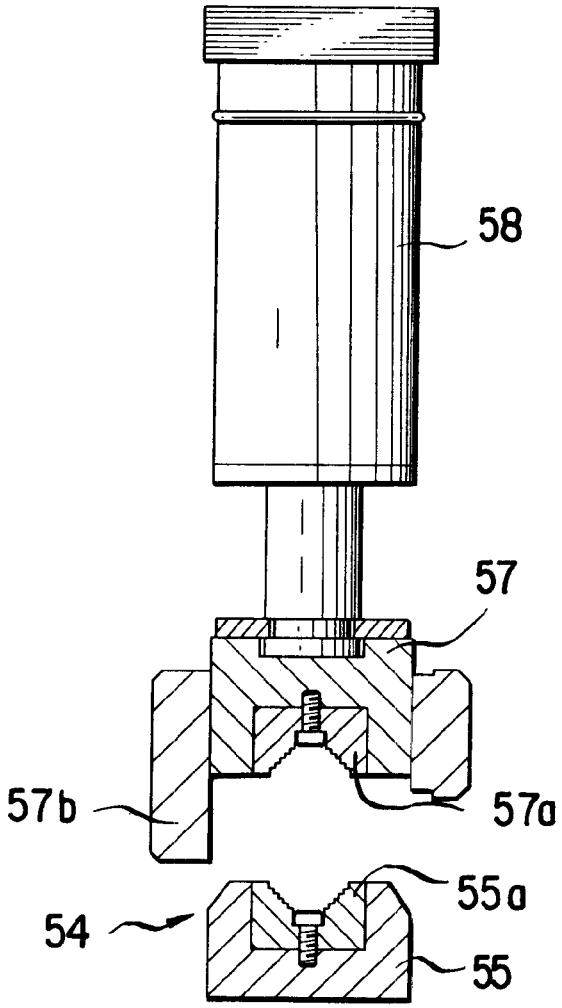
FIG. 11 is a sectional view taken along the line XI—XI in FIG. 9.

The stationary grasping portion 55 and the movable grasping portion 57 are formed detachably, as shown in FIG. 11, with grasping pieces 55*a* and 57*a*, each having a V-shaped section, so as to grasp the rod between these V-shaped portions of the grasping pieces 55*a* and 57*a*. The movable grasping portion 57 has a lower portion to which a movable grasp guide 57*b* is attached. The movable grasping portion 57 projects on the side of the stationary grasping portion 55 over the grasping piece 57*a*.

The rod can be inserted into the portion between the stationary grasping portion 55 and the movable grasping portion 57 through a hollow portion 53*a* of the hollow pin 53.

FIGS. 9 and 10 show a release state in which the grasping state is released and the stationary grasping portion 55 and the movable grasping portion 57 are spaced, and in this state, the respective grasping pieces 55*a* and 57*a* are spaced by a distance through which the rod can be inserted.

In the rod inserted state, when the cylinder 58 is expanded, the movable grasping portion 57 is moved, together with a piston rod 58 of the cylinder 58, towards the stationary grasping portion 55 till the grasping piece 57*a*of the movable grasping portion 57 abuts against the rod.

Thereafter, when the cylinder 58 is further expanded, a cylinder tube 58*b* is moved, together with the side plates 56, in a direction reverse to that mentioned above with respect to the piston rod 58*a* because the movable grasping portion 57 now abutting against the rod is not moved further, and as a result, the stationary grasping portion 55 is moved, together with the side plates 56, towards the movable grasping portion 57 and, then, the grasping piece 55*a* abuts against the rod.

In this manner, the rod is grasped, i.e., clamped, by the grasping pieces 55*a* and 57*a* of the stationary and movable grasping portions 55 and 57, respectively.

On the contrary, when the cylinder 58 is contacted in the state mentioned above, the respective members and portions mentioned above are moved or operated in the manner reverse to that mentioned above so as to take a grasping release state shown in FIG. 8 or 9.

Figure 12:
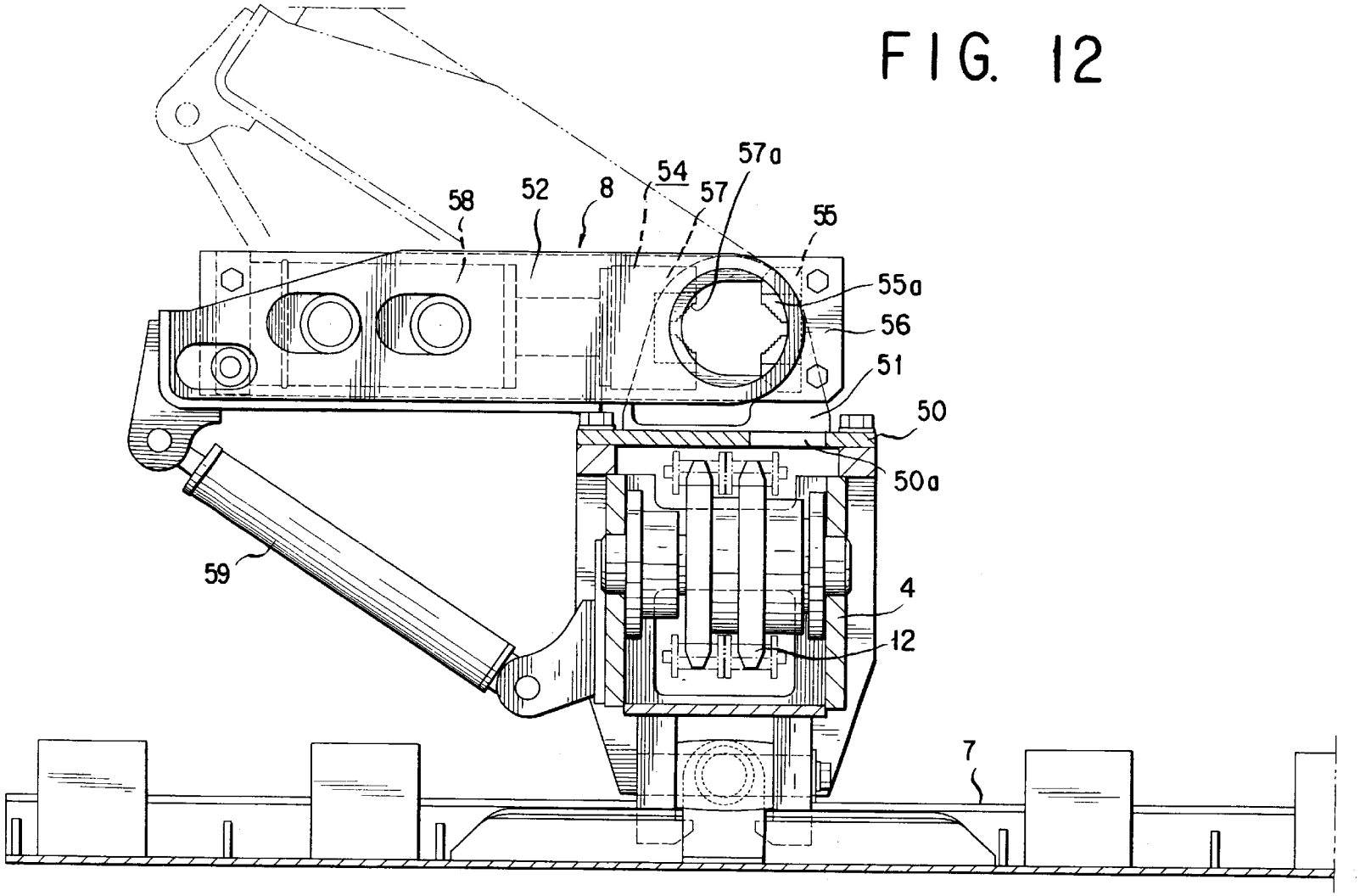
FIG. 12 is a sectional view taken along the line XII—XII in FIG. 9.

With reference to FIG. 12, a cylinder 59 is connected with the body portion 52 of the rod wrench 80 and the frame 4 between them, and when this cylinder 59 is expanded or contracted, the rod wrench 8 is vertically swung in the shown state. The plate 50 is formed with a hole 50*a* so that the side plates 56 do not interfere with the plate 50 at the time when the rod wrench 8 is swung upward.

Referring to FIG. 10, a link 60 is connected with the body portion 52 of the rod damper 9 and the frame structure 4 between them so as to fix the rod damper 9 at substantially a horizontal attitude in the shown state.

Figure 13:
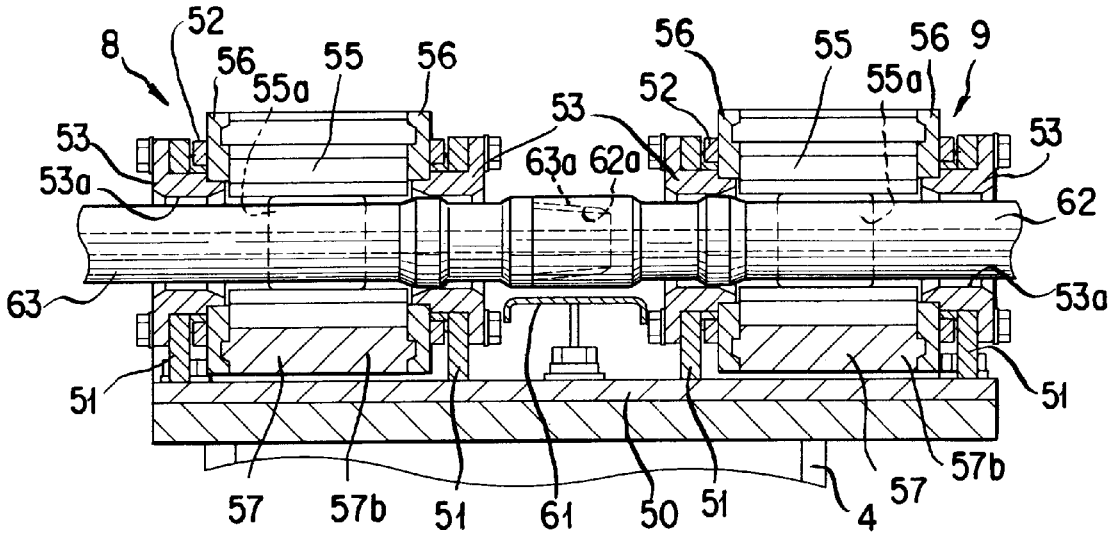
FIG. 13 is a sectional view taken along the line XIII—XIII in FIG. 9.

Further, as shown in FIG. 13, the hollow portions 53*a*of the above-mentioned tow-paired hollow pins 53 are arranged to be substantially coaxial so as to provide a state that the rods 62 and 63 can be continuously inserted into the rod grasping portion 54 of the rod wrench 8 and the rod grasping portion 54 of the rod damper 9.

The plate 50 is mounted with a receiving plate 61 so that the rods can be smoothly inserted into the hollow portions 53 of the hollow pins 53, respectively.

According to the structures mentioned above, as shown in FIG. 13, the preceding rod 62, for example, the rod 62 having a drill head having an inclined surface at the front end portion thereof and propelled into the ground, is grasped (clamped) by the stationary grasping portion 55 and the movable grasping portion 57 of the rod damper 9, and then, a male screw portion 63*a* of a succeeding rod 63 connected to the rotation shaft 41 rotated by the motor 6 and propelled by the cradle 5 is forced against a female screw portion 62*a* of the preceding rod 62 to be screwed therein. Thus, the succeeding rod 63 is connected with the preceding rod 62.

The disconnection of the succeeding rod 63 from the preceding rod 62 is performed as follows. The preceding rod 62 and the succeeding rod 63 can be unscrewed by grasping the preceding rod 62 and the succeeding rod 63 by the rod damper 9 and the rod wrench 8, respectively and expanding the cylinder 59 so as to swing upward the rod wrench 8. In succeeding, the succeeding rod 63 is released from the grasp by the rod wrench 8 and rotated by the cradle 5 in the unscrewing direction, so that the succeeding rod 63 is separated from the preceding rod 62.

Next, the concrete structure or shape of the rod exchanger (rod exchanging device) 30 will be described. Further, although the rod exchanger 30 is mounted to the machine body 1 in a manner inclining with respect to a horizontal plane, this matter will be explained with showing the rod exchanger in a horizontal state.

Figure 14:
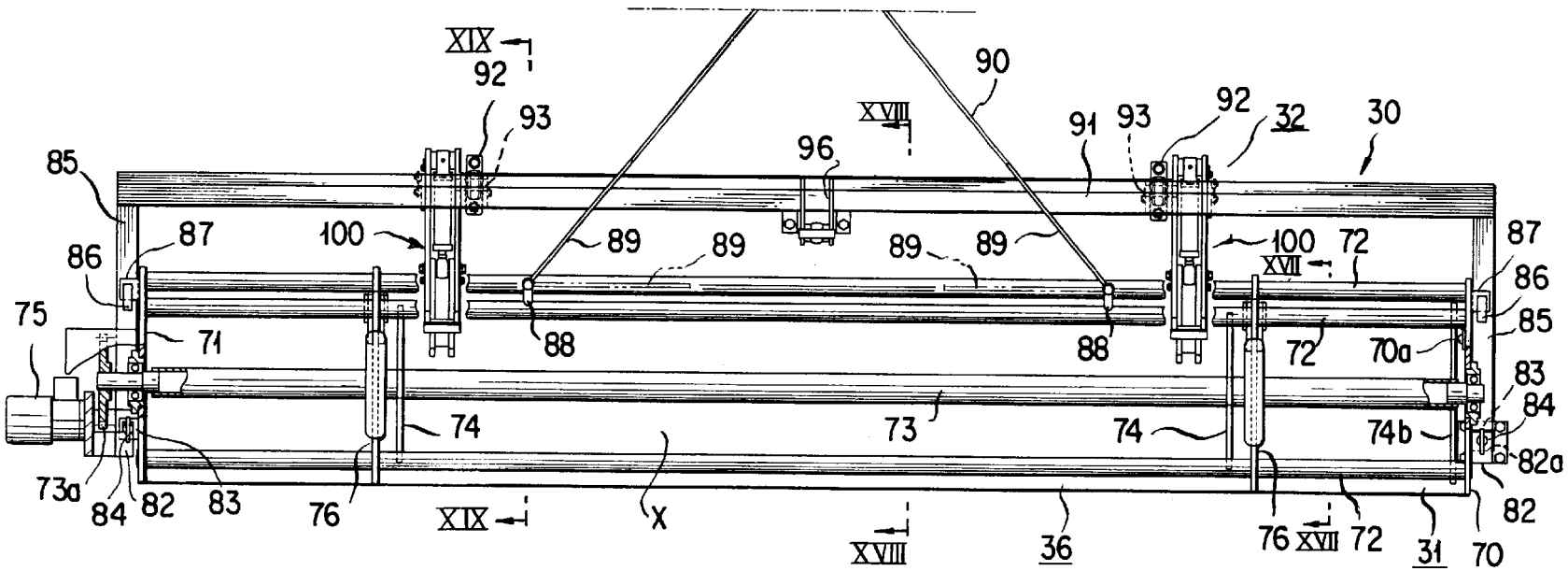
FIG. 14 is a right side view showing one example of a rod exchanger of the ground drilling machine of FIG. 1.
Figure 15:
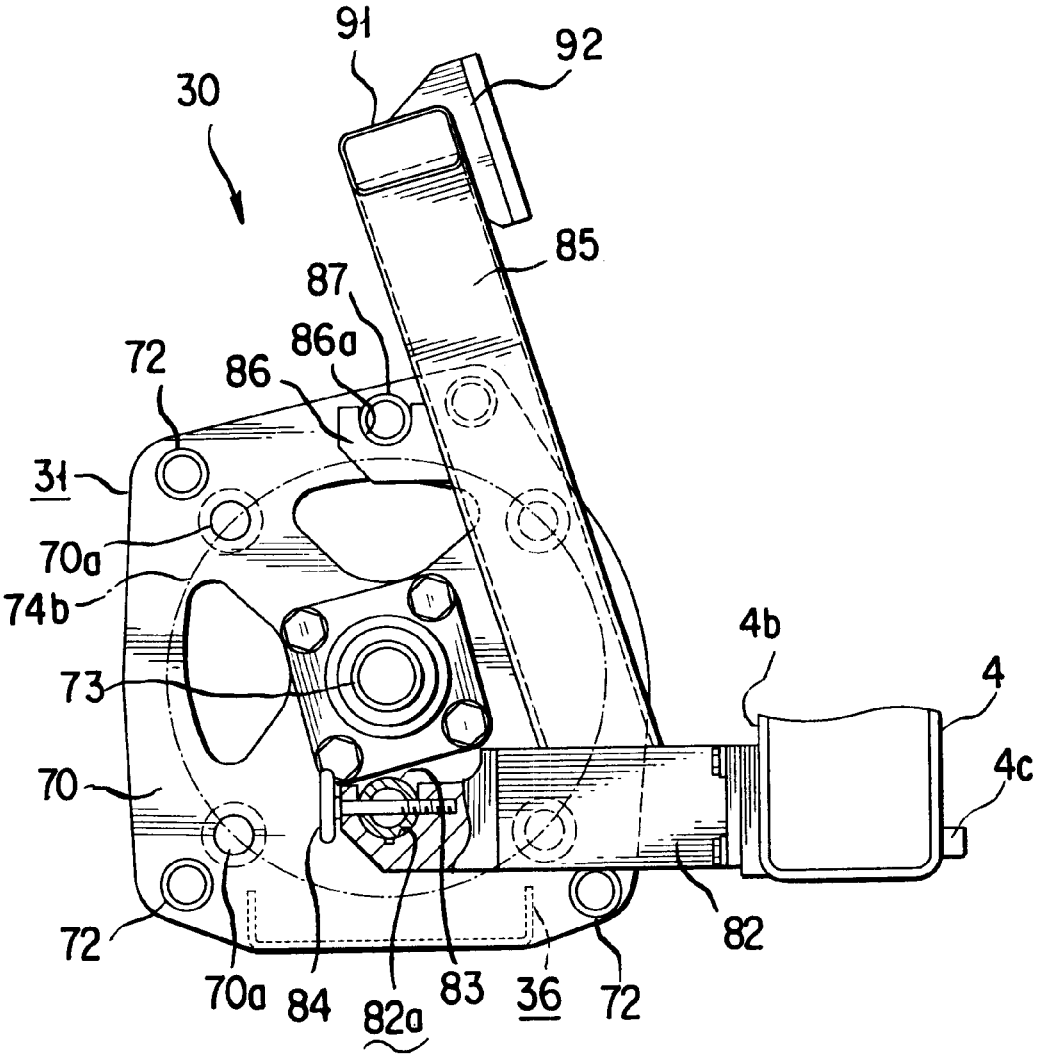
FIG. 15 is a front view of the rod exchanger of FIG. 14.
Figure 16:
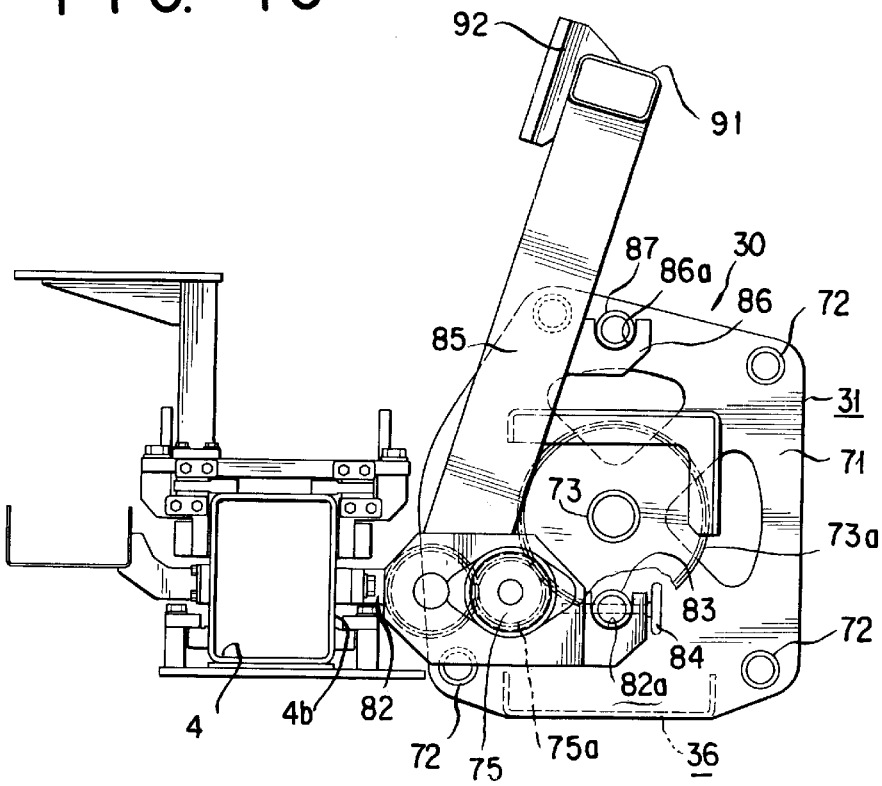
FIG. 16 is a back view of the rod exchanger of FIG. 14.

With reference to FIGS. 14, 15 and 16, a front side plate 70 (lower side plate in an inclining direction) and a rear side plate 71 (upper side plate in the inclining direction), both having approximately rectangular shape, are coupled with an interval by means of a plurality of coupling members in the shape of rods 72.

Figure 17:
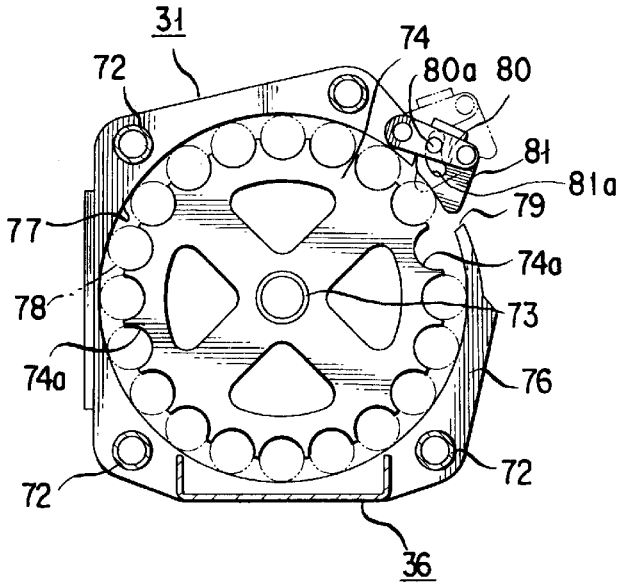
FIG. 17 is a sectional view taken along the line XVII—XVII in FIG. 14.

A rotation shaft 73 is also supported to be rotatable between the front and rear side plates 70 and 71, and a plurality of rod accommodation plates 74 are mounted to this rotation shaft 73 with intervals in the longitudinal direction thereof. Each of the rod accommodation plates 74 has a disc shape, as shown in FIG. 17, and is formed with a plurality of rod receiving recesses 74*a* at its outer periphery with intervals along the circumferential direction thereof.

A rod support plate 74*b* is attached to the most front side (right side end portion as viewed in FIG. 14, for example) of the rotation shaft 73. This rod support plate 74*b* has a disc shape and contacts a plurality of balls 70*a* arranged to the front side plate 70 and then supports the rods so as not to be moved in the longitudinal direction. The respective rod accommodation plates 74, each having the structure mentioned above, are rotated together with the rotation shaft 73 which is driven by means of motor 75.

According to the structure mentioned above, a rod accommodation unit (section) X is constituted by the rotation shaft 73, the plural rod accommodation plates 74 and the rod support plate 74*b*, and such rod accommodation unit X is rotatable and receives a plurality of rods with spaces along the circular locus.

A pair of rod coming-off prevention plates 76 are arranged to both end sides in the longitudinal direction of the coupling rods 72.

This rod coming-off prevention plate 76 is formed, as shown in FIG. 17, with a substantially circular guide hole 77 concentrical with the rotation shaft 73, and a ring-shaped space is formed between the guide hole 77 and the outer peripheral portion of the rod accommodation plate 74.

A rod 78 accommodated in the recess 74*a* of the rod accommodation plate 74 contacts the guide hole 77 so that the rod 78 is not come off at the time when the rod accommodation plate 74 is rotated together with the rotation shaft 73.

The rod coming-off prevention plate 76 is formed, on its frame side portion, with a cutout opening 79 for transferring the rod. This cutout opening 79 has a dimension, in its rotational direction, larger by a diameter of one rod. A link 80 is attached, to be vertically swingable, to an upper edge portion of the cutout opening 79 and a press piece 81 is attached to this link 80 to be swingable. A pin 80*a* secured to the link 80 is fitted into an arcuate groove 81*a* formed to the press piece 81 to thereby limit or restrict the swingable range of the press piece 81 with respect to the link 80.

Thus, as mentioned above, this press piece 81 acts to prevent the coming-off of the rod from the cutout opening 79 at the rotating time. At the rod taking-out time, the press piece 81 together with the link 80 is swung by the rod 78, and at the rod accommodating time, the press piece 81 is swung inward with respect to the link 80 along the pin 80*a*.

The aforementioned slide frame 36 is arranged throughout the lower portions of the front side plate 70, the rear side plate 71 and the rod coming-off prevention plate 76 as best shown in FIG. 14, for example.

According to the structure mentioned above, the body portion 31 of the rod exchanger 30, having a rod accommodating portion which accommodates a plurality of rods along the circular locus with spaces and is rotatable, is formed.

Furthermore, with reference to FIGS. 15 and 16, a pair of transverse mounting members 82 are fastened by means of bolts to both end side portions in the longitudinal direction of the opposite side surface 4*b* to the operator's seat 20, of the frame structure 4 of the rod propelling device 3.

Each of these transverse mounting members 82 is provided with a recessed portion 82*a* having an upward opening and each of the front and rear side plate 70 and 71 is provided with a circular lower mounting projection 83 at a portion lower than the rotation shaft 73 of the front and rear side plates 70 and 71. The lower mounting projection 83 is fitted into the upward recessed portion 82*a* and then fixed, to be detachable, to the transverse mounting member 82 by screwing a locking screw 84 throughout the lower mounting projection 83.

Vertical mounting members 85 are secured to the transverse mounting members 82, respectively, to thereby constitute a mounting structure.

A bracket 86 formed with recessed portions 86*a* opened upward is fixed to each of the vertical mounting members 85 to a position above the rotation shaft 73. Furthermore, circular upper mounting projections 87 are formed to the front side plate 70 and the rear side plate 71, respectively, and the upper mounting projections 87 are fitted into the upward recessed portions 86*a* formed to the bracket 86.

Figure 18:
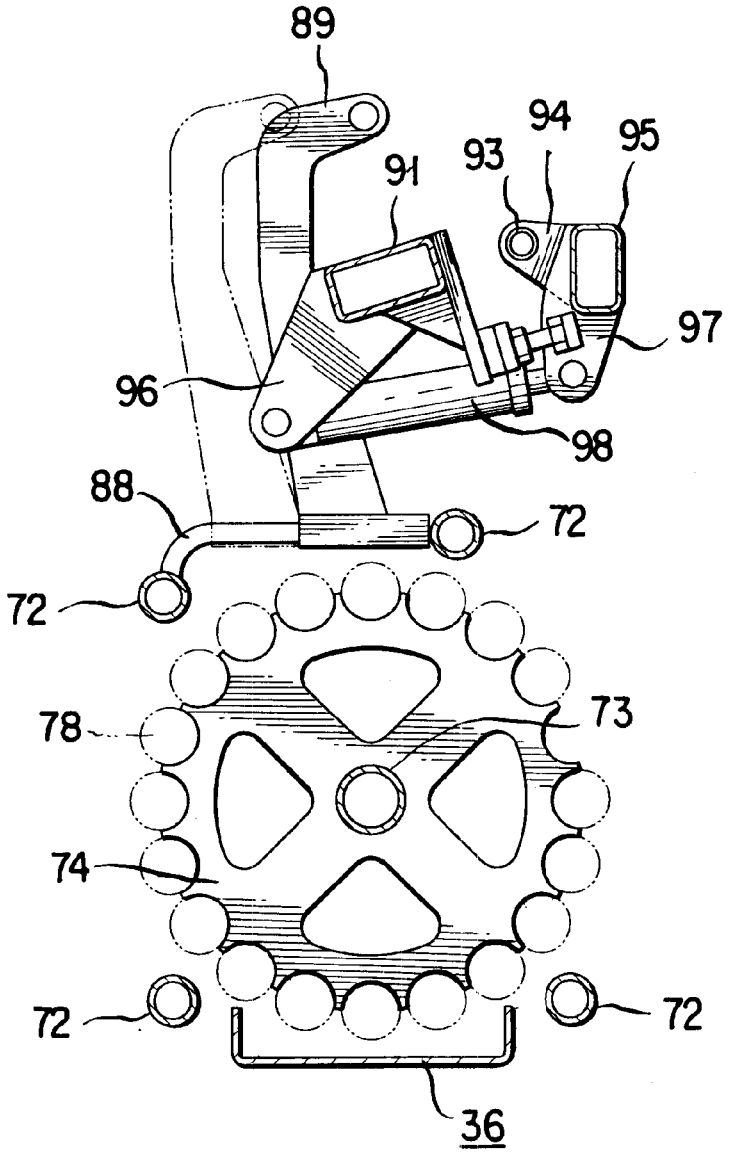
FIG. 18 is a sectional view taken along the line XVIII—XVIII in FIG. 14.

Further with reference to FIGS. 14 and 18, a pair of rod members 88 are secured to intermediate portions in the longitudinal direction of the two connection rods 72 mounted to the upper side portions of the front and rear side plates 70 and 71, and arms 89 are secured to the respective rod members 89 to be vertically swingable and laterally slidable.

Each of the respective arms 89 usually takes a tilted attitude contacting the connection rod 72 as shown in FIG. 14 with an image line, and at a time of removing the main body portion 31 of the rod exchanger 30, takes an obliquely upward attitude as shown in FIG. 14 with a solid line so as to be lifted upward by means of crane, for example, through a lifting rope 90 or like.

As mentioned above, by connecting the lifting rope 90 to the arm 89 and unscrewing the lateral locking screws 84, the main body portion 31 of the rod exchanger 30 can be lifted up. Further, the motor 75 is mounted to the transverse mounting member 82 as shown in FIGS. 14 and 16, and a gear 75*a* driven by the motor 75 is meshed with a gear 73*a* mounted to the rotation shaft 73, so that the gear 73*a* is moved upward together with the main body portion 31 to be thereby separated from the gear 75*a*.

Further, the main body portion 31 of the rod exchanger 30 can be temporarily attached to the frame structure 4 by lowering the main body portion 31 of the lifted-up rod exchanger 30 and then fitting the upper and lower mounting projections 87 and 83 into the upward recessed portion 86*a* of the bracket 86 and the upward recessed portion 82*a* of the transverse mounting member 82, respectively.

In this state, the main body portion 31 of the rod exchanger 30 can be attached to the frame structure 4 by screwing the locking screws 84.

Thus, according to the manner mentioned above, the main body portion 31 of the rod exchanger 30 can be easily attached or detached.

Furthermore, a transverse connection member 91 is secured to the paired vertical mounting members 85 so as to extend therebetween. A pair of brackets 92 are mounted with a space to a surface of the transverse connection member 91 on the side of the frame 4.

Figure 19:
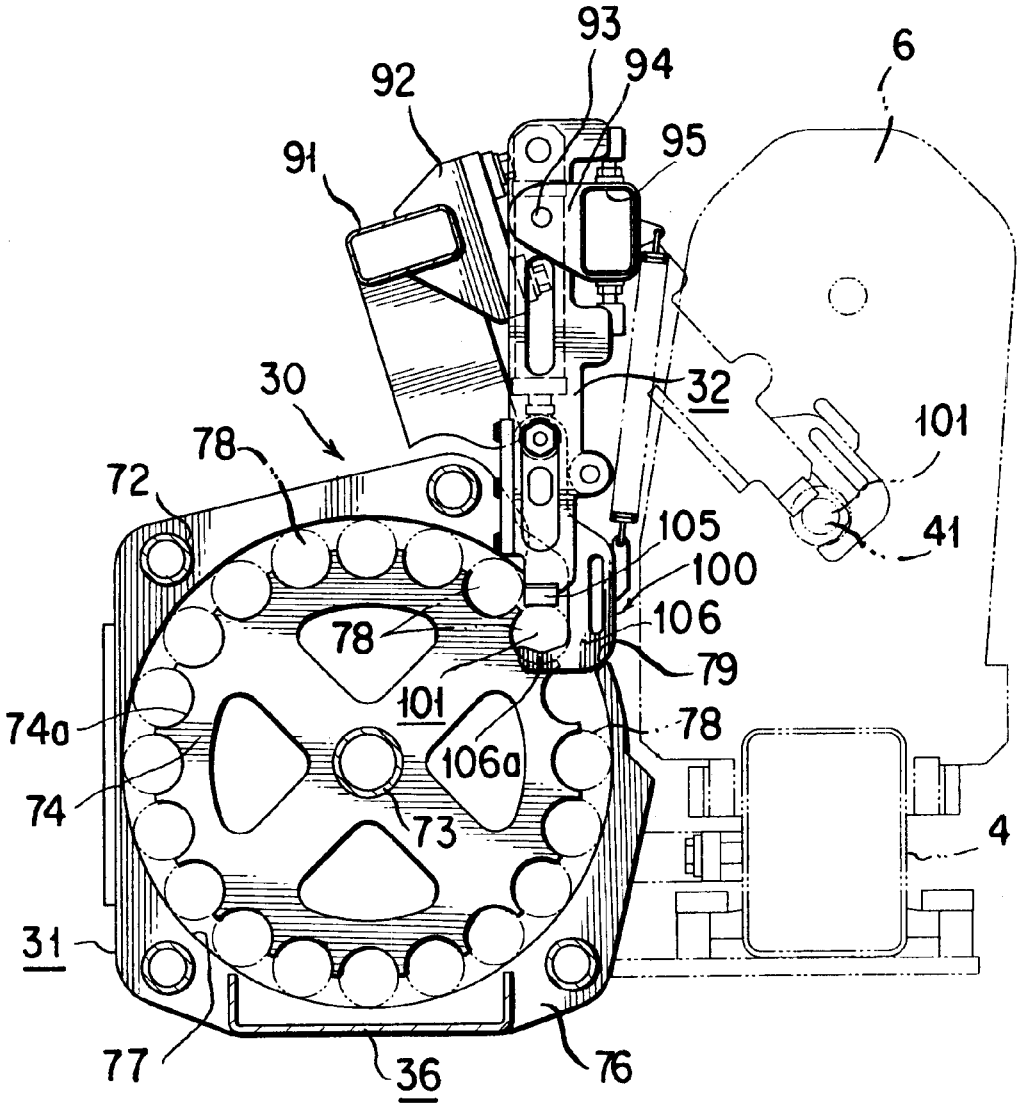
FIG. 19 is a sectional view taken along the line XIX—XIX in FIG. 14.

As shown in FIG. 19, a transverse shaft 93 is secured to each of these brackets 92, and each of other brackets 94 is supported to each of these transverse shafts 93 to be swingable. A transverse member 95 is further connected between these brackets 94, and this transverse member 95 is mounted to be swingable with respect to the transverse connection member 91.

Furthermore, as shown in FIG. 18, a bracket 96 is fixed to a surface, opposite to the side of the frame 4, of the longitudinally central portion of the transverse connection member 91, and a cylinder 98 for the swing motion is connected between this bracket 96 and the bracket 97 fixed to the transverse member 95. Further, a pair of rod grasping devices 100 are mounted to longitudinal both end portions of the transverse member 95, respectively.

According to the manner mentioned above, a rod exchanging unit (section) 32 is constituted, which will be operated as follows.

The rod grasping devices 100 are swung between a position inside the main body portion 31 of the rod exchanger 30 as shown with the solid line in FIG. 19 and a position outside the main body portion 31 (i.e., frame side position) shown with an imaginary line upon the expansion and contraction of the cylinder 98.

In an arrangement in which each of the rod grasping devices 100 is positioned in the main body portion 31 of the rod exchanger 30, the grasping portion 101 projects inside the cutout opening 79 of the rod coming-off prevention plate 76.

On the other hand, in the arrangement in which each of the rod grasping devices 100 is positioned to the frame side position mentioned hereinbefore, the grasping portion 101 accords with the center of the rotation shaft 41 rotated by means of the rod rotating motor 6.

The concrete structure of the rod grasping device 100 will be described hereunder.

Figure 20:
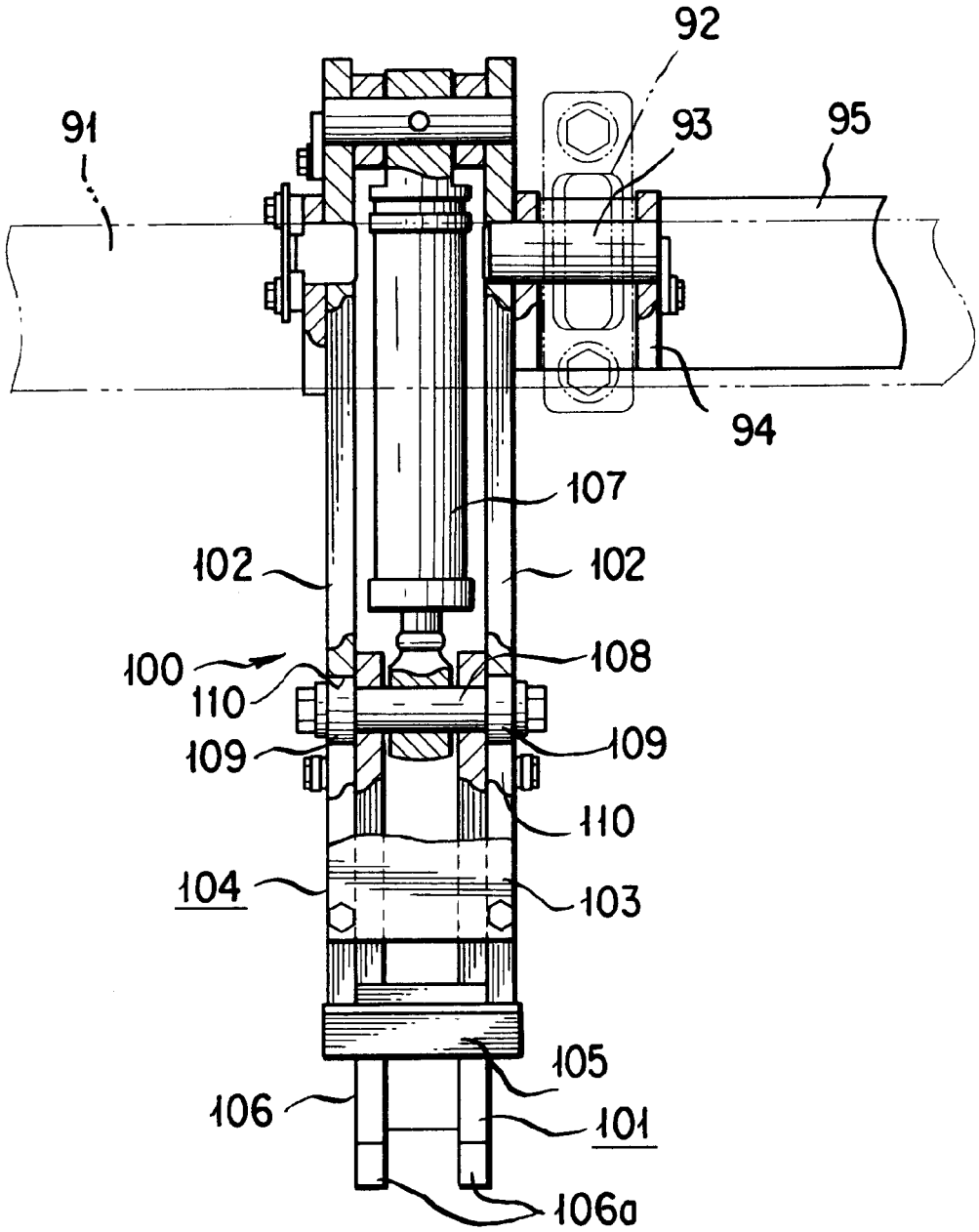
FIG. 20 is a right side view, in an enlarged scale, of a rod grasping device of the rod exchanger of FIG. 14.
Figure 21:
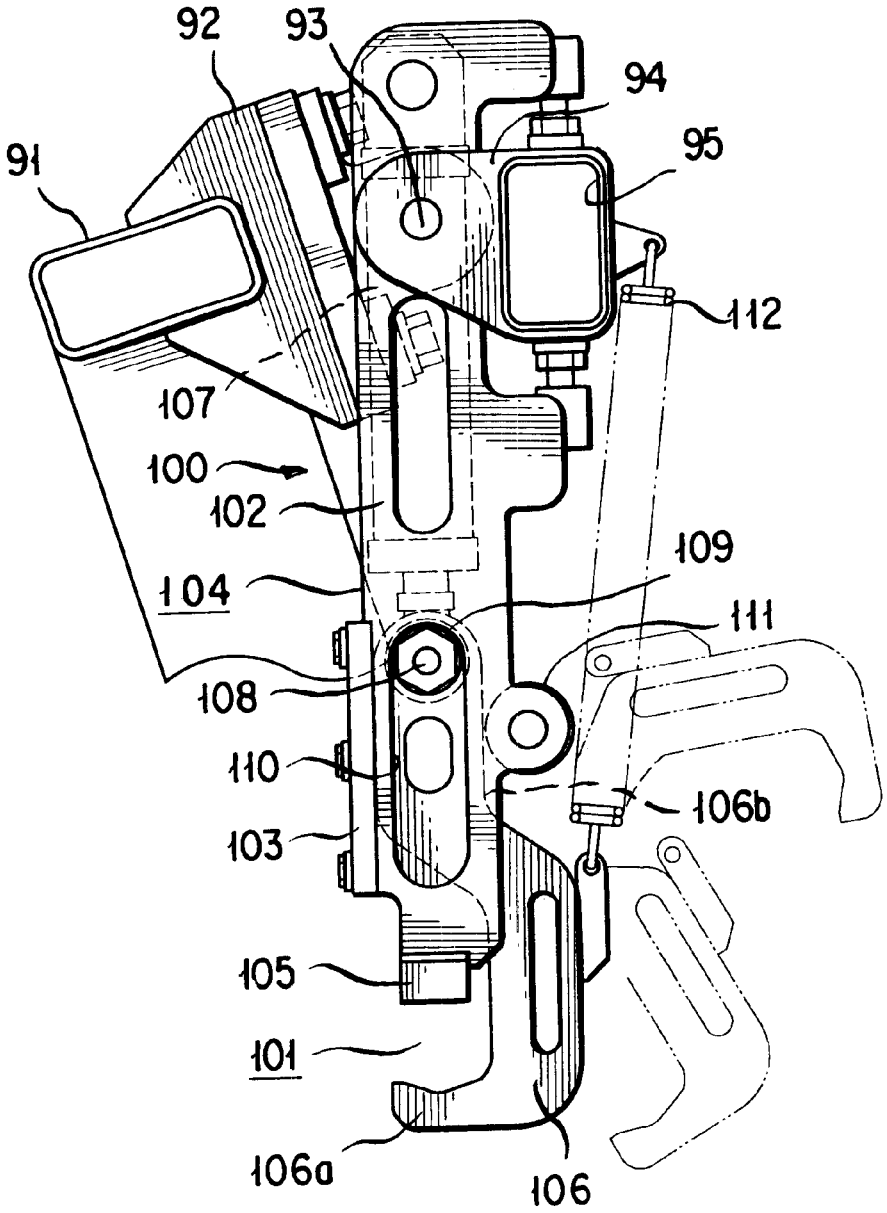
FIG. 21 is an enlarged front view of the rod grasping device of FIG. 20.

With reference to FIGS. 20 and 21, the rod grasping device 100 is provided with a body portion 104 which is formed by connecting lower portions of a pair of side plates 102 through a plate 103 with a space, and an upper portion of the body portion 104 is attached to the transverse member 95.

The paired side plates 102 have lower end portions to which a fixed portion 105 is mounted.

A movable portion 106 is bent so as to provide substantially a crank-shaped structure, and a claw portion 106*a* is formed to the lower end portion thereof so as to direct transversely. The upper portion of the movable portion 106 is coupled via a pin 108, to be swingably, to a cylinder 107 for grasping which is mounted to the upper portion of the body portion 104.

Rollers 109 are mounted to both ends of the pin 108 so as to be slidably fitted into vertically elongated guide slots 110 formed to the paired side plates 102, so that, upon the expansion or contraction of the grasping cylinder 107, the pin 108, i.e., upper portion of the movable claw 106, is vertically linearly moved along the guide slot 110. That is, rollers 109 and the guide slots 110 constitute a guide unit (section) for linearly moving the upper portion of the movable portion 106 (i.e., coupling portion between the grasping cylinder 107 and the movable portion 106).

Furthermore, rollers 111 are mounted to the paired side plates 102 at portions corresponding to intermediate portions in the longitudinal direction of the guide slots 110. The movable portion 106 is urged upward by means of spring 112, and an opposite side surface 106*b* to the claw portion 106*a*, of the movable portion 106 contact to the rollers 111 for the movable portion 106 in a slidable manner.

Hereunder, rod grasping operation and releasing operation by means of the rod grasping devices will be described.

At the time when the grasping cylinder 107 is contracted, the movable portion 106 moves upward along the rollers 111 for the movable portion 106, so that the movable portion 106 is swung downward against the urging force of the spring 112 and the claw portion 106*a* of the movable portion 106 takes the rod grasping position opposing to the fixed portion 105.

When the grasping cylinder 107 is further contracted from the position mentioned above, the movable portion 106 moves linearly upward towards the fixed portion 105 to thereby take a position shown in FIG. 21 with the solid line, at which the rod is clamped, i.e., grasped, by the claw portion 106*a* and the fixed portion 105. At this time, the claw portion 106*a* and the fixed portion 105 form the grasping unit (section) mentioned hereinbefore.

When the grasping cylinder 107 is expanded from the aforementioned state, the movable portion moves down and, then, is swung gradually upward by means of the spring 112 to thereby take the releasing position shown with the imaginary line in FIG. 21. In this state, the claw portion 106*a* is apart from the fixed portion 105.

As mentioned above, the movable portion 106 is swung between the grasping position opposing to the fixed portion 105 and the releasing position apart from the fixed portion, so that the grasping and releasing operation for the rod can be performed even with a small space in which the movable portion 106 can be swung therebetween. Accordingly, the circumferential intervals of the recessed portions 74*a* for receiving the rods of the rod accommodation plate 74 can be made small so as to receive the rods as many as possible.

For example, as shown in FIG. 19, according to the structure mentioned above, the fixed portion 105 is located above one rod 78, and the movable portion 106 is swung with the state that the next rod receiving recess 74*a* receives no rod to thereby grasp the rod 78. Accordingly, a lot of rods 78 can be accommodated.

Figure 22:
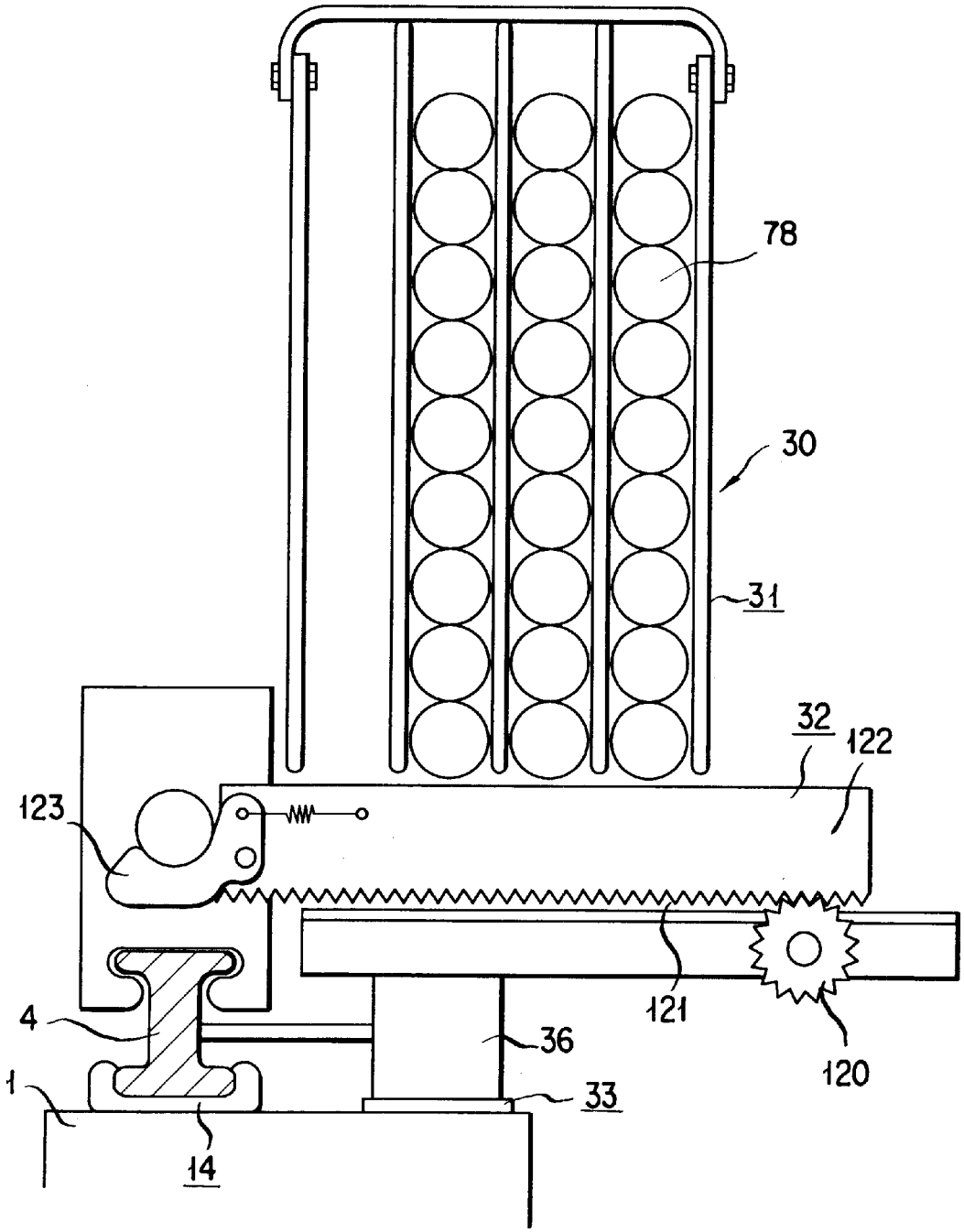
FIG. 22 is a front view of another example of a rod exchanger of the ground drilling machine of FIG. 1.

FIG. 22 represents another example of the rod exchanger 30, in which the main body portion 31 has a structure capable of accommodating the rods 78 in an superposed state in the vertical direction as viewed.

With reference to this example of the rod exchanger of FIG. 22, the rod exchanging section 32 is composed of a movable portion 122, which is reciprocally movable by an associated operation of a pinion 120 and a rack 121 and a rod receiving member 123 mounted to the movable portion 122 to be swingable. According to this structure, the rod 78 accommodated in the main body portion is received on the rod receiving member 123 by moving the movable portion 122 and then moved to the frame structure 4 by moving the movable portion 122 towards the frame structure 4.

Further, in this example, the main body portion 31 of the rod exchanger 30 is mounted to the frame structure 4, and the slide frame 36 contacts the support portion 33 of the machine body 1 to thereby support the rod exchanger 30 by the machine body 1.

Further, it is to be noted that, in the described embodiment, the present invention will be utilized as a ground drilling machine by propelling under the ground a rod provided with a leading portion having the inclined pressure receiving surface. It may be utilized as a crawler drill by utilizing a rod having a drill bit.

Furthermore, the frame structure may be arranged horizontally or to be vertically swingable in place of the inclined structure. The frame 4 may be fixed without being movable in the longitudinal direction thereof.

Still furthermore, it is further noted that, although the present invention is disclosed as an invention which is applicable to the ground drilling machine and the rod exchanger utilized therefor, the present invention is not limited to such specific embodiment or application, and many other applications will be suggested for those skilled in the art. Furthermore, it will be caused for experts in this art field to make various amendments, modifications and changes in the details of the illustrated and described embodiments so as to be conformed with design or like or with the necessity of the applications. Accordingly, it is reasonable that the present invention is understood by a method coincident with correct meaning or proper aspect of broader scopes of the appended claims.

What is claimed is:

1. A ground drilling machine comprising:

a machine body;

a rod propelling device having a frame structure movably mounted to the machine body;

a support portion provided for the machine body for supporting the frame structure;

a rod exchanging device attached to the frame structure of the rod propelling device; and a support unit provided for the machine body for supporting the rod exchanging device;

wherein said frame structure is slidable on the support portion; and said rod exchanging device is slidable on the support unit along with the movement of the rod propelling device.

2. A ground drilling machine according to claim 1, wherein said rod exchanging device comprises a main body portion having a rod accommodation portion for accommodating a plurality of rods with a space from each other, and a rod exchanging unit provided with a space from each other, and a rod exchanging unit provided with a rod grasping device having a grasping portion which is movable between a position inside the main body portion and a position outside the main body portion, said grasping portion being formed with a fixed portion and a movable portion.

3. A ground drilling machine according to claim 2, wherein said rod accommodation portion has a disc shaped structure adapted to accommodate a plurality of rods along the circular locus thereof with a space from each other and to be rotatable.

4. A rod exchanging device comprising:

a main body portion;

a rod accommodation portion mounted to the main body portion for accommodating a plurality of rods with a space from each other; and a rod exchanging unit provided with a rod grasping device having a grasping portion which is movable between a position inside the main body portion and a position outside the main body portion, said grasping portion being formed with a fixed portion and a movable portion;

wherein said rod accommodation portion has a disc shaped structure adapted to accommodate a plurality of rods along the circular locus thereof with a space from each other and to be rotatable; and said rod grasping device comprises, a device body, said fixed portion fixedly mounted to the device body, said movable portion slidably and swingably mounted to the device body, a roller mounted to the device body and contacted with a side surface of the movable portion in a slidable manner, a cylinder for moving the movable portion along the roller, and a spring for urging the movable portion to swing to a releasing position, wherein said movable portion is swung between a grasping position opposing to the fixed portion and the releasing position apart from the fixed portion by cooperation of the roller, the cylinder and the spring.

* * * * *